United States Patent [19]

Seaborn et al.

[11] Patent Number: 4,610,059

[45] Date of Patent: Sep. 9, 1986

[54] WARP MONITORING AND BEAMING PROCESS

[75] Inventors: Douglas K. Seaborn, Cantonment; William T. Dowell, Pensacola, both of Fla.

[73] Assignee: Monsanto Company, St. Louis, Mo.

[21] Appl. No.: 678,130

[22] Filed: Dec. 4, 1984

[51] Int. Cl.[4] ..... D02H 13/08

[52] U.S. Cl. ..... 28/187

[58] Field of Search ..... 28/186, 187; 226/25; 200/61.13; 242/155 R

[56] References Cited

U.S. PATENT DOCUMENTS

| | | | |
|---|---|---|---|
| 2,314,070 | 3/1943 | Bogoslowsky | 242/155 R |
| 2,536,537 | 1/1951 | Christiansen et al. | 242/155 R |
| 3,746,226 | 7/1973 | Leclercq | 226/25 |
| 4,407,767 | 10/1983 | Seaborn . | |

*Primary Examiner*—Robert R. Mackey

*Attorney, Agent, or Firm*—John W. Whisler

[57] ABSTRACT

In a warping process, the yarns are overfed into an accumulator comprising an individual tension detector for each yarn. The overfeed reduces the tension and thus the frictional drag as the yarns pass in a partial wrap around their tension detectors, permitting higher warping speeds.

8 Claims, 2 Drawing Figures

WARP MONITORING AND BEAMING PROCESS

The invention relates to the art of warping a weftless warp sheet of yarns onto a beam. More particularly, it relates to maintaining proper yarn tensions while warping at high speeds.

It is conventional in the textile industry to form a weftless warp sheet of parallel yarns and to wind the warp sheet onto a large spool called a beam. The process is variously referred to as warping or beaming. The warp sheets commonly comprise hundreds or thousands of individual yarns, and are unwound from the beams to feed looms, warp knitting machines, and the like.

The source of warp yarns which are to be beamed is typically a creel supporting a separate yarn package for each yarn in the warp sheet. The individual yarns are withdrawn from the packages and fed through an arrangement of guides to form the warp sheet.

It is known to feed the warp sheet through an accumulator comprising a tension detector for each yarn between the creel and the beam. One such known arrangement is disclosed in Seaborn U.S. Pat. No. 4,407,767, the disclosure of which is incorporated herein by reference. The Seaborn arrangement is quite satisfactory when operated at conventional warping speeds. When warping at speeds above about 400 YPM (360 MPM) using an accumulator comprising a tension detector for each yarn, excessive tensions occur on occasion.

It has been discovered that such excessive tensions are caused at least in part by frictional drag between the individual yarns and their associated individual tension sensers. According to the present invention, provision is made for reducing the undesired increase in tension which occurs within the accumulator.

Figure 1:
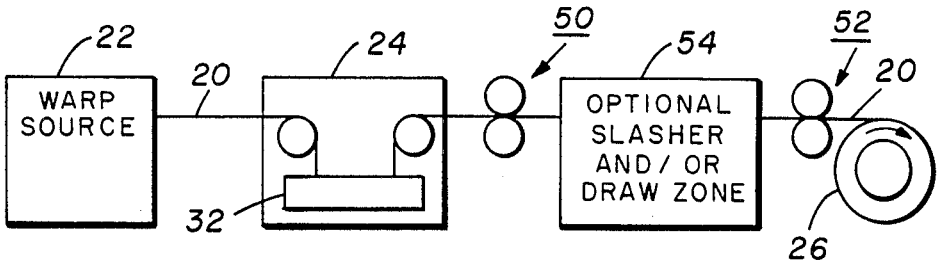
Figure 2:
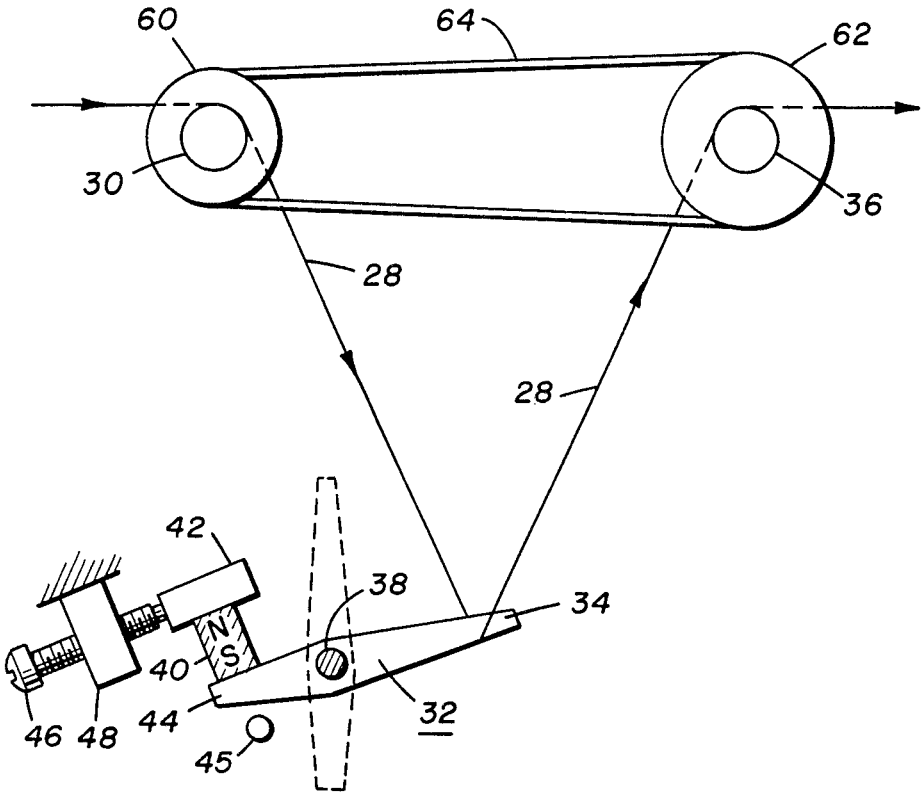

Various aspects of the invention will in part appear hereinafter and will in part be obvious from the following detailed description taken in connection with the accompanying drawings, wherein:

FIG. 1 is a schematic diagram of a warping or beaming operation in which the invention may be used, and FIG. 2 is a side elevation view, partly in section, of the preferred embodiment of the invention, showing an individual yarn tension detector together with the inlet and outlet rolls according to the invention.

As illustrated in FIG. 1, in the general process of warping or beaming, warp sheet 20 composed of a plurality of individual yarns is fed from warp source 22 through accumulator 24, is optionally drawn and/or slashed at 54, and is subsequently wound on beam 26. If warp sheet 20 is not to be drawn or slashed, nip rolls 50 and 52 may be omitted. Warp source 22 will ordinarily be a creel supporting a corresponding plurality of yarn packages. Accumulator 24 generates a signal when the tension in any of the yarns equals a predetermined non-zero level, and the process is stopped in response to the signal. The predetermined non-zero tension level is selected to be low enough that the process stops before the tension in the yarn rises high enough to damage the yarn.

Accumulator 24 preferably comprises an individual tension detector 32 for each yarn 28, the particularly preferred form of individual tension detector 32 being illustrated in FIG. 2. Each individual yarn 28 passes over inlet roll 30 and loops downwardly under horizontal finger 34 of its associated individual tension detector 32, then upwardly and over outlet roll 36 before proceeding to further processing steps. Ferromagnetic individual tension detector 32 is pivotally mounted on horizontal shaft 38 and is normally maintained in an approximately horizontal position by magnet 40 rigidly mounted on moveable support 42 and cooperating with tail 44 on individual tension detector 32. Yarn 28 thus forms a running bight in detector 24 whereby the quantity of yarn in the bight is continuously stored. Accumulator 24 accordingly temporarily and continuously stores a quantity of each yarn constituting the warp sheet.

In operation, individual tension detector 32 is normally maintained in the horizontal position illustrated in solid lines in FIG. 2 by magnet 40. If yarn 28 snags or otherwise encounters excessive resistance in warp source 22, the tension in the yarn will increase to some level predetermined by the strength of magnet 40 and by the distance from magnet 40 to shaft 38 as compared to the distance from shaft 38 to the point on finger 34 contacted by yarn 28. When this predetermined level of tension is exceeded, the magnetic force is overcome and individual tension detector 32 pivots counterclockwise as viewed in FIG. 2. As individual tension detector 32 pivots toward the position indicated in dotted lines, it interrupts a horizontal beam of light perpendicular to the plane of the drawing and directed onto photocell 45. Interruption of the light beam generates a signal which, by conventional control circuitry, stops the process before tension becomes high enough to damage the snagged yarn. Release of the stored quantity of yarn prevents yarn tension from exceeding the desired level if the process is stopped before the stored quantity of yarn is exhausted. The stored quantity of yarn is accordingly selected with respect to the process speed and inertia so as to be large enough to compensate for the time required to stop the process.

The predetermined level of tension required to actuate finger 34 and thus release yarn 28 can be readily adjusted. Screw 46 is threaded through stationary frame member 48 and engages support 42, such that by adjustment of screw 46 the distance between magnet 40 and pivot 38 can be adjusted.

The apparatus as thus far specifically described is (except for replacement of rods 30 and 36 in the Seaborn patent noted above with rolls 30 and 36 herein) substantially the same as that disclosed in the Seaborn patent, and performs very well at conventional warping speeds.

It has now been discovered that as warping speeds are increased above about 400 YPM (360 MPM), tensions within and downstream from the accumulator increase to undesirable levels due to the snubbing effect of the partial wrap of each yarn 28 around its associated individual tension detector 32.

According to the invention, these undesirable tension levels are avoided by providing a common or shared inlet roll 30 about which yarns 28 pass in a partial wrap upon entering accumulator 24 and a common or shared outlet roll 36 about which yarns 28 pass in a partial wrap upon leaving accumulator 24, inlet roll 30 being driven at a higher peripheral speed than outlet roll 36. The speeds of rolls 30 and 36 and the coefficients of friction between the yarns and the peripheral surfaces of the rolls are selected such that each of the yarns is normally subjected to lower tension just prior to contact with its associated individual tension detector 32 than just prior to contact with roll 30. This reduces the tension of each yarn 28 while it is in contact with its associated individual tension detector 32, reducing the noted snubbing effect. Ordinarily it is advantageous to reduce the yarn tension to a level as low as possible while still maintaining contact between the yarns and the tension detectors.

Outlet roll 36 advantageously is driven by frictional contact with yarns 28 leaving accumulator 24, and preferably drives inlet roll 30 at a higher peripheral speed than roll 36. As illustrated, this may be done by providing pulleys 60 and 62 mounted on rolls 30 and 36 respectively, with belt 64 connecting pulleys 60 and 62. The diameters of the pulleys are selected such that roll 30 is driven at a higher peripheral speed than roll 36.

EXAMPLE

This is an example of warping tire yarn having 840 denier and 140 filaments. 304 bobbins of such yarns are mounted in a creel used as warp source 22. The yarns are withdrawn from the creel and passed through accumulator 24 as above described prior to being wound on beam 26 at 600 YPM (about 540 MPM). In this example, elements 50–54 in the drawings are omitted. Rolls 30 and 36 each have a diameter of 4 inches (about 10 centimeters). Roll 36 is provided with a peripheral surface having a coefficient of static friction greater than that of roll 30. Thus, roll 36 is provided with a polished chromium peripheral surface, while roll 30 is provided with a peripheral surface coated with poly(tetrafluoroethylene). Pulleys 60 and 62 are selected such that roll 30 has a peripheral speed about 5% faster than roll 36. The warping process proceeds with excellent performance.

When rolls 30 and 36 are replaced with plain metal rods as in the Seaborn patent above, the process cannot be successfully run at such speeds.

From the above disclosure it may be seen that according to a first principal aspect of the invention, in a warping process wherein a plurality of individual yarns are withdrawn from a like plurality of bobbins, passed through an accumulator and wound on a beam as a weftless warp sheet, the accumulator comprising means for continuously storing a quantity of each of the yarns, means for detecting the tension in each of the yarns, and means for stopping the process upon occurence of tension in any given one of the yarns equal to a given level, there is provided the improvement comprising passing each of the yarns sequentially in a partial wrap around the peripheral surface of a common inlet roll upon entry to the accumulator, in a partial wrap around a corresponding individual tension detector, and in a partial wrap around the peripheral surface of a common outlet roll upon leaving the accumulator, and driving the inlet roll at a faster peripheral speed than the peripheral speed of the outlet roll, the speeds of the inlet and outlet rolls and the coefficients of friction between the yarns and the peripheral surfaces of the rolls being selected such that each of the yarns is subjected to lower tension just prior to contact with its corresponding individual tension detector than just prior to contact with the inlet roll.

According to another aspect of the invention, the outlet roll is driven by frictional contact with the yarns leaving the accumulator, and advantageously the inlet roll is driven by the outlet roll.

According to another aspect of the invention, the peripheral surface of the inlet roll has a coefficient of static friction with the yarn lower than that of the peripheral surface of the outlet roll. The peripheral surface of the inlet roll is preferably formed of a polymeric organic material, which preferably comprises poly(tetrafluoroethylene).

We claim:

1. In a warping process wherein a plurality of individual yarns are withdrawn from a like plurality of bobbins, passed through an accumulator and wound on a beam as a weftless warp sheet, said accumulator comprising means for continuously storing a quantity of each of said yarns, means for detecting the tension in each of said yarns, and means for stopping the process upon occurence of tension in any given one of said yarns equal to a given level, the improvement comprising:

a. passing each of said yarns sequentially
   (1) in a partial wrap around the peripheral surface of a common inlet roll upon entry to said accumulator,
   (2) in a partial wrap around a corresponding individual tension detector, and
   (3) in a partial wrap around the peripheral surface of a common outlet roll upon leaving said accumulator, and b. driving said inlet roll at a faster peripheral speed than the peripheral speed of said outlet roll, c. the speeds of said rolls and the coefficients of static friction between said yarns and the peripheral surfaces of said rolls being selected such that each of said yarns is normally subjected to lower tension just prior to contacting its said corresponding individual tension detector than just prior to contacting said inlet roll.

2. The warping process defined in claim 1, wherein said outlet roll is driven by frictional contact with said yarns leaving said accumulator.

3. The warping process defined in claim 2, wherein said inlet roll is driven by said outlet roll.

4. The warping process defined in claim 1, wherein said inlet roll is driven by said outlet roll.

5. The process defined in claim 1, wherein said peripheral surface of said inlet roll has a coefficient of static friction with said yarn lower than that of said peripheral surface of said outlet roll.

6. The process defined in claim 5, wherein said peripheral surface of said inlet roll is formed of a polymeric organic material.

7. The process defined in claim 6, wherein said polymeric material comprises fluorine.

8. The process defined in claim 7, wherein said polymeric material comprises poly(tetrafluoroethylene).

* * * * *